US011904212B2

(12) United States Patent
Campbell

(10) Patent No.: US 11,904,212 B2
(45) **Date of Patent: *Feb. 20, 2024**

(54) SPORTS BALL

(71) Applicant: Under Armour, Inc., Baltimore, MD (US)

(72) Inventor: Derek Campbell, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 159 days.

This patent is subject to a terminal disclaimer.

(21) Appl. No.: 17/206,586

(22) Filed: Mar. 19, 2021

(65) Prior Publication Data

US 2021/0346767 A1 Nov. 11, 2021

Related U.S. Application Data

(63) Continuation of application No. 16/456,605, filed on Jun. 28, 2019, now Pat. No. 10,967,229, which is a continuation of application No. 15/879,955, filed on Jan. 25, 2018, now Pat. No. 10,376,749, which is a continuation of application No. 15/480,895, filed on Apr. 6, 2017, now Pat. No. 10,195,492.

(60) Provisional application No. 62/318,914, filed on Apr. 6, 2016.

(51) Int. Cl.
*A63B 41/08* (2006.01)
*A63B 43/00* (2006.01)

(52) U.S. Cl.
CPC ..... *A63B 41/08* (2013.01); *A63B 43/00* (2013.01); *A63B 43/008* (2013.01); *A63B 2225/01* (2013.01)

(58) Field of Classification Search
CPC ..... A63B 41/08; A63B 43/00; A63B 43/008; A63B 2225/01
See application file for complete search history.

(56) References Cited

U.S. PATENT DOCUMENTS

| | | | |
|---|---|---|---|
| D45,734 | S | 1/1865 | Worthington |
| D45,827 | S | 1/1865 | Worthington |
| D46,783 | S | 3/1865 | Worthington |
| D58,166 | S | 9/1866 | Thomlinson |
| 1,656,408 | A | 1/1928 | Young |
| 2,129,238 | A | 9/1938 | Riddell |
| 2,214,179 | A | 9/1940 | Reach |
| 2,309,865 | A | 2/1943 | Reach |

(Continued)

FOREIGN PATENT DOCUMENTS

| | | | | |
|---|---|---|---|---|
| DE | 102015209811 | * | 5/2015 | |
| EP | 3097958 A2 | * | 11/2016 | ..... A63B 37/04 |

OTHER PUBLICATIONS

International Search Report and Written Opinion of corresponding PCT/US2017/026326, dated Jul. 7, 2017.

*Primary Examiner* — Steven B Wong
(74) *Attorney, Agent, or Firm* — Maginot, Moore & Beck, LLP

(57) ABSTRACT

A sports ball comprises a bladder and a contouring layer surrounding the bladder. The contouring layer includes at least one panel defining a repeating pattern of perforations configured to lower a Poisson's ratio of the contouring layer. Each of said perforations defines a reentrant shape and a constant cross-sectional width in a radial direction of the ball.

10 Claims, 11 Drawing Sheets

(56) References Cited

U.S. PATENT DOCUMENTS 5,181,717 A * 1/1993 Donntag ..... A63B 41/08 273/DIG. 8
5,320,345 A 6/1994 Lai
5,413,331 A 5/1995 Stillinger
5,580,049 A 12/1996 Brantley
5,931,752 A 8/1999 Guenther
6,024,661 A 2/2000 Guenther
6,302,815 B1 10/2001 Shishido et al.
6,569,038 B2 5/2003 Sullivan
6,663,520 B2 12/2003 Ou
6,685,585 B2 2/2004 Shishido et al.
6,916,263 B1 7/2005 Pacheco
6,971,965 B1 12/2005 Shishido
6,988,969 B2 1/2006 Avis
7,125,347 B2 10/2006 Kawamatsu
7,753,813 B2 7/2010 Taniguchi et al.
7,935,013 B2 5/2011 Pacheco
8,529,386 B2 9/2013 Nuernberg et al.
8,597,450 B2 12/2013 Rapaport et al.
D697,150 S 1/2014 Otto
8,632,430 B2 1/2014 Avis et al.
8,684,870 B2 4/2014 Ito
9,211,446 B2 12/2015 Berggren
9,272,190 B2 3/2016 Tompkins
9,370,695 B2 6/2016 Chang et al.
9,539,472 B2 1/2017 Smith et al.
9,539,473 B2 1/2017 Berggren et al.
9,586,098 B1 * 3/2017 Ahsan ..... A63B 45/00
D783,099 S 4/2017 Dhirmalani
10,195,492 B2 * 2/2019 Campbell ..... A63B 43/00
10,376,749 B2 * 8/2019 Campbell ..... A63B 43/008
10,967,229 B2 * 4/2021 Campbell ..... A63B 43/00
2004/0142779 A1 7/2004 Chan
2004/0144477 A1 7/2004 Raniguchi et al.
2005/0170921 A1 8/2005 Cronin
2005/0176533 A1 8/2005 Chan
2005/0277499 A1 12/2005 Tang
2006/0084536 A1 4/2006 Taniguchi
2006/0293132 A1 12/2006 Laliberty et al.
2007/0117662 A1 5/2007 Ma
2007/0161440 A1 * 7/2007 Chang ..... A63B 41/02 473/603
2008/0032834 A1 2/2008 Krysiak
2008/0070727 A1 3/2008 Avis
2008/0139349 A1 6/2008 Ou
2009/0093327 A1 4/2009 Maziarz et al.
2009/0105019 A1 4/2009 Keppler
2009/0209374 A1 8/2009 Ou
2009/0325744 A1 12/2009 Raynak et al.
2009/0325746 A1 12/2009 Raynak
2010/0317472 A1 12/2010 Maziarz et al.
2011/0177895 A1 * 7/2011 Lin ..... A63B 41/02 473/605
2011/0224034 A1 9/2011 Rastegar et al.
2012/0021167 A1 * 1/2012 Plant ..... F16F 7/122 428/116
2012/0142465 A1 6/2012 Berggren
2012/0329587 A1 12/2012 Ou
2014/0059734 A1 3/2014 Toronjo
2014/0087899 A1 3/2014 Raynak et al.
2014/0109286 A1 * 4/2014 Blakely ..... A43B 23/0215 2/69
2014/0179469 A1 6/2014 Berggren et al.
2014/0274504 A1 9/2014 Hu et al.
2015/0367183 A1 12/2015 Ou
2017/0042285 A1 * 2/2017 Lawless ..... A43B 13/187
2017/0050089 A1 * 2/2017 Olivares Velasco ... A63B 45/00
2017/0203161 A1 7/2017 Ahsan
2017/0291076 A1 10/2017 Campbell
2018/0338572 A1 * 11/2018 Cross ..... A43B 13/04
2021/0386151 A1 * 12/2021 Blakely ..... A42B 1/22

* cited by examiner

SPORTS BALL

CROSS-REFERENCE TO RELATED APPLICATIONS

This application is a continuation of U.S. patent application Ser. No. 16/456,605 entitled "Sports Ball," filed Jun. 28, 2019 (now U.S. Pat. No. 10,967,229), which is a continuation of U.S. patent application Ser. No. 15/879,955 entitled "Sports Ball," filed Jan. 25, 2018 (now U.S. Pat. No. 10,376,749), which application is a continuation of U.S. patent application Ser. No. 15/480,895, entitled "Sports Ball," filed Apr. 6, 2017 (now U.S. Pat. No. 10,195,492), which application claims priority to U.S. Provisional Application Ser. No. 62/318,914 entitled "Sports Ball Having a Flexible Cover Layer," filed Apr. 6, 2016, the entire disclosures of which are incorporated by reference herein.

FIELD

This document relates to the field of athletics, and particularly to sports balls used for athletic events including athletic training and ball games.

BACKGROUND

Sports balls are widely used in association with numerous athletic activities and sporting events, including soccer, basketball, football, volleyball, baseball, and golf, to name a few. The type of ball used in each of these athletic activities differs, depending on the activity. Some balls, such as golf balls and baseballs, are generally solid from cover to core. Other balls are filled with air and include an interior bladder with an outer cover.

When forming a ball, the cover of the ball typically includes features that are unique to the particular type of ball. Even for the same type of ball, the design of the cover may provide features that distinguish two different balls. For example, the cover of a first basketball may provide a durable rubber surface that makes the ball appropriate for use outdoors on concrete surfaces. The cover of a second basketball may provide a softer surface with a better grip, but the softer surface would tend to wear out quickly on concrete surfaces, so the second ball is designed for indoor use. Accordingly, when designing a ball, the manufacturer must consider both the type of ball to be designed along with the desired performance characteristics of the ball that will appeal to a particular user. Examples of performance characteristics include the shape, feel, texture, hardness, durability, resilience, and any number of different performance characteristics for the ball. In some situations, performance characteristics and other ball design considerations are governed by a league or other governing body. For example, a governing body may mandate the size, shape, weight, or other standards for a ball.

In addition to considering performance characteristics and design standards when designing a ball, the manufacturer must also consider other factors. For example, a desirable look and visual appeal of the ball is important when the ball is on the shelf and following purchase, when the ball is in play by the user. To this end, the manufacturer must consider expectations for the visual design and color of the ball. Furthermore, in order to produce the ball in an economic fashion, the user must consider the costs of labor and materials to produce the ball in an attempt to offer a high quality ball at the desired price point.

In view of the foregoing, it would be desirable to provide a sports ball having a unique cover configured to offer unique performance characteristics. It would also be desirable to provide a ball having a cover that provides a unique look and feel for the user. It would also be desirable if such a ball could be manufactured in an economic manner.

SUMMARY

In accordance with at least one exemplary embodiment of the disclosure, a sports ball comprises a bladder and a contouring layer surrounding the bladder. The contouring layer includes at least one panel defining a repeating pattern of perforations configured to lower a Poisson's ratio of the contouring layer. Each of said perforations defines a reentrant shape and a constant cross-sectional width in a radial direction of the ball.

In accordance with yet another exemplary embodiment, there is provided a ball comprising a bladder and a multi-layer cover. The multi-layer cover includes an outer layer and an intermediate layer between the outer layer and the bladder. The intermediate layer includes at least one perforated panel comprising a plurality of perforations. The outer layer includes a plurality of dimples, wherein each of the plurality of dimples is aligned with one of the plurality of perforations.

In at least one exemplary embodiment, a sports ball comprises a bladder, a contouring layer, and an outer layer. The contouring layer surrounds the bladder and is comprised of at least one panel defining an array of apertures. The outer layer surrounds the contouring layer. The array of apertures of the at least one perforated panel is detectable by at least one human sense via the outer layer.

In at least one additional exemplary embodiment, a sports ball comprises a plurality of interlocking panels covered by an outer layer. Each of the interlocking panels includes a plurality of recesses. The outer layer includes a plurality of distinct surface irregularities, each of the surface irregularities aligned with one of the plurality of recesses.

In at least one embodiment, each of the interlocking panels is an auxetic structure. The auxetic structure defines a repeating pattern of reentrant shapes, each of the reentrant shapes is defined by one of the apertures. In at least one embodiment, one of the interlocking panels is positioned in a pole region and interlocks with another interlocking panel in an equator region of the ball.

The above described features and advantages, as well as others, will become more readily apparent to those of ordinary skill in the art by reference to the following detailed description and accompanying drawings. While it would be desirable to provide a sports ball that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
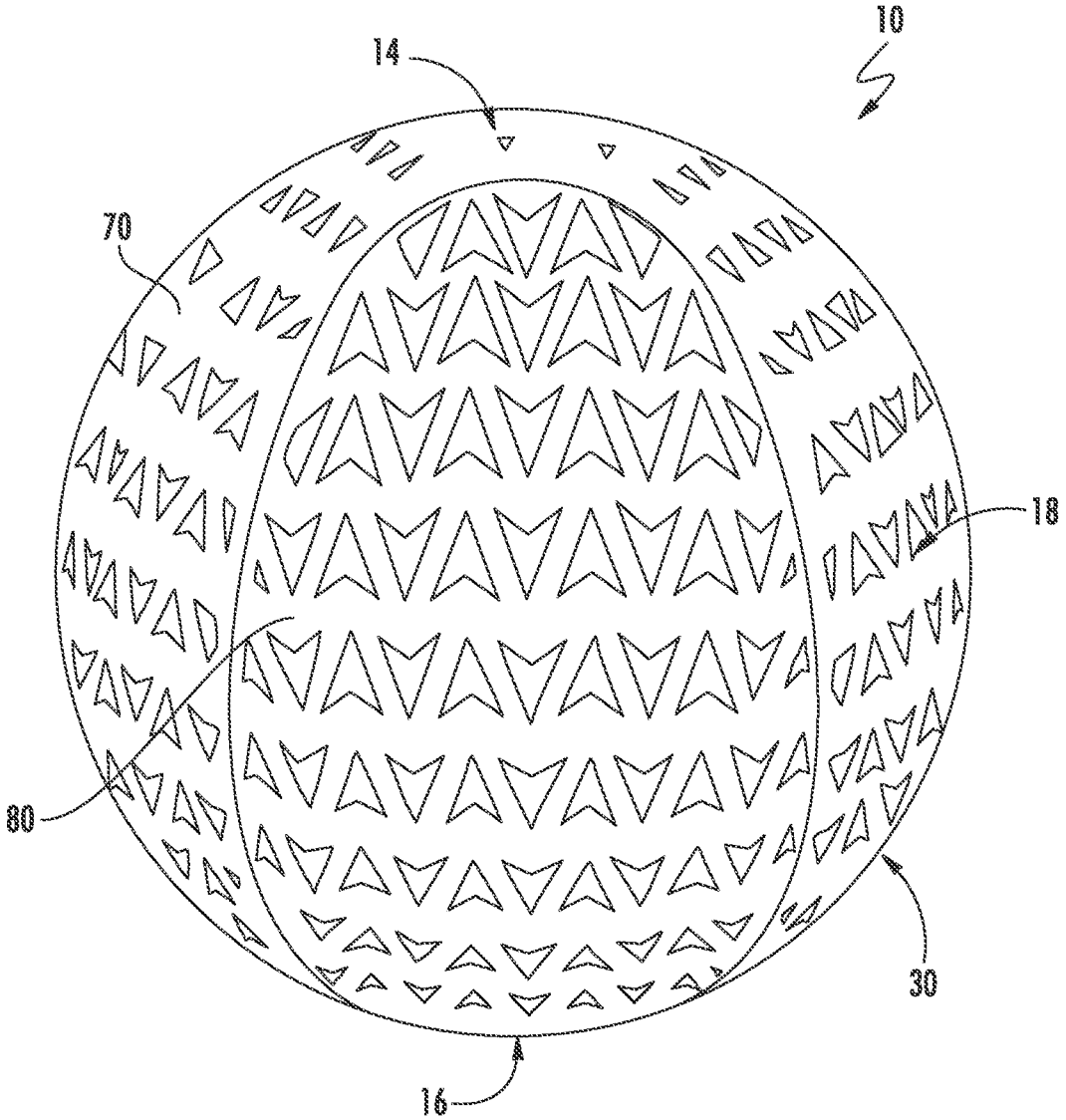
FIG. 1 shows a perspective view of a ball including a flexible cover layer.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be per-formed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

With general reference to FIGS. 1-5, a ball 10 is shown including a multi-layer cover 30. The ball 10 is in the form of a sports ball, and particularly a soccer ball. Accordingly, the ball 10 may be provided having any of various dimensions. For example, when the ball is a soccer ball, the ball may have a diameter of about 22 cm. The multi-layer cover 30 wraps around and surrounds an interior bladder 20. The multi-layer cover 30 includes a substrate layer 40, an outer layer 50, and an intermediate layer 60. The intermediate layer 60 is formed by a first panel 70 and an interlocking second panel 80. Each panel 70, 80 of the intermediate layer 60 includes a pattern of perforations in the form of recesses 90 that facilitate flexing of the panels 70, 80 around the ball 10 when the intermediate layer 60 is secured to the ball 10.

Figure 2:
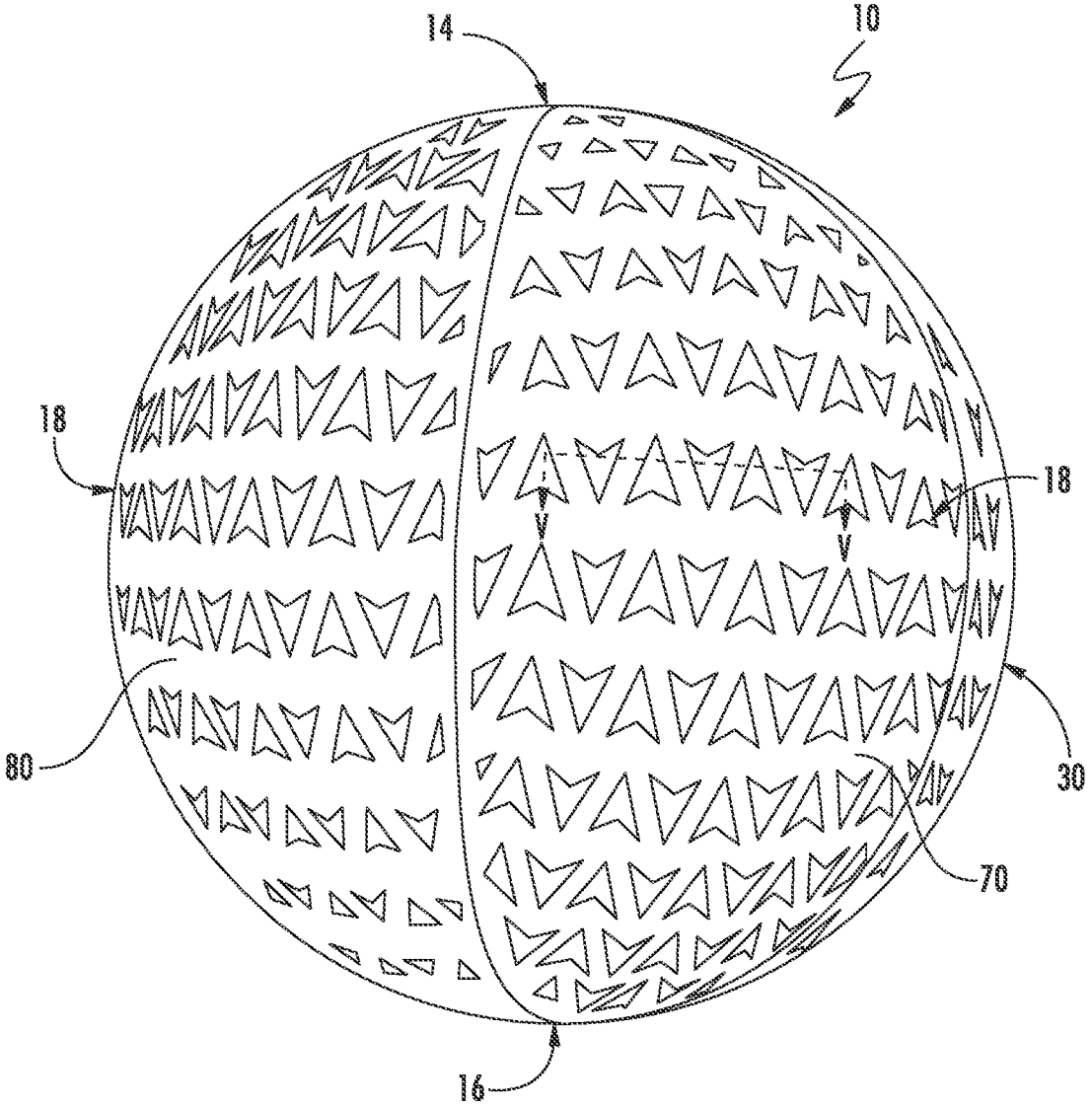
FIG. 2 shows an equatorial view of the ball of FIG. 1.
Figure 3:
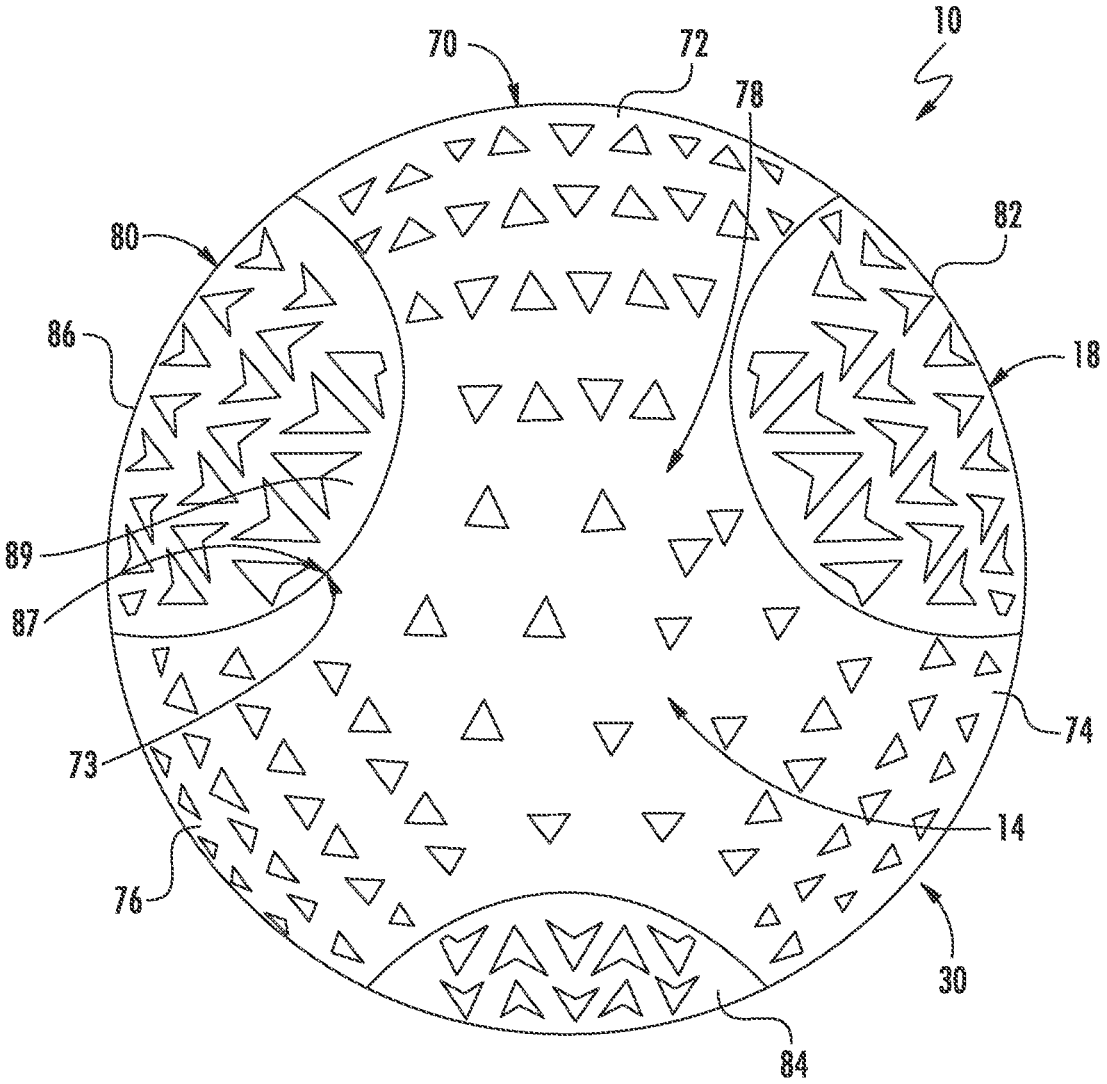
FIG. 3 shows a first pole view of the sports ball of FIG. 1.
Figure 4:
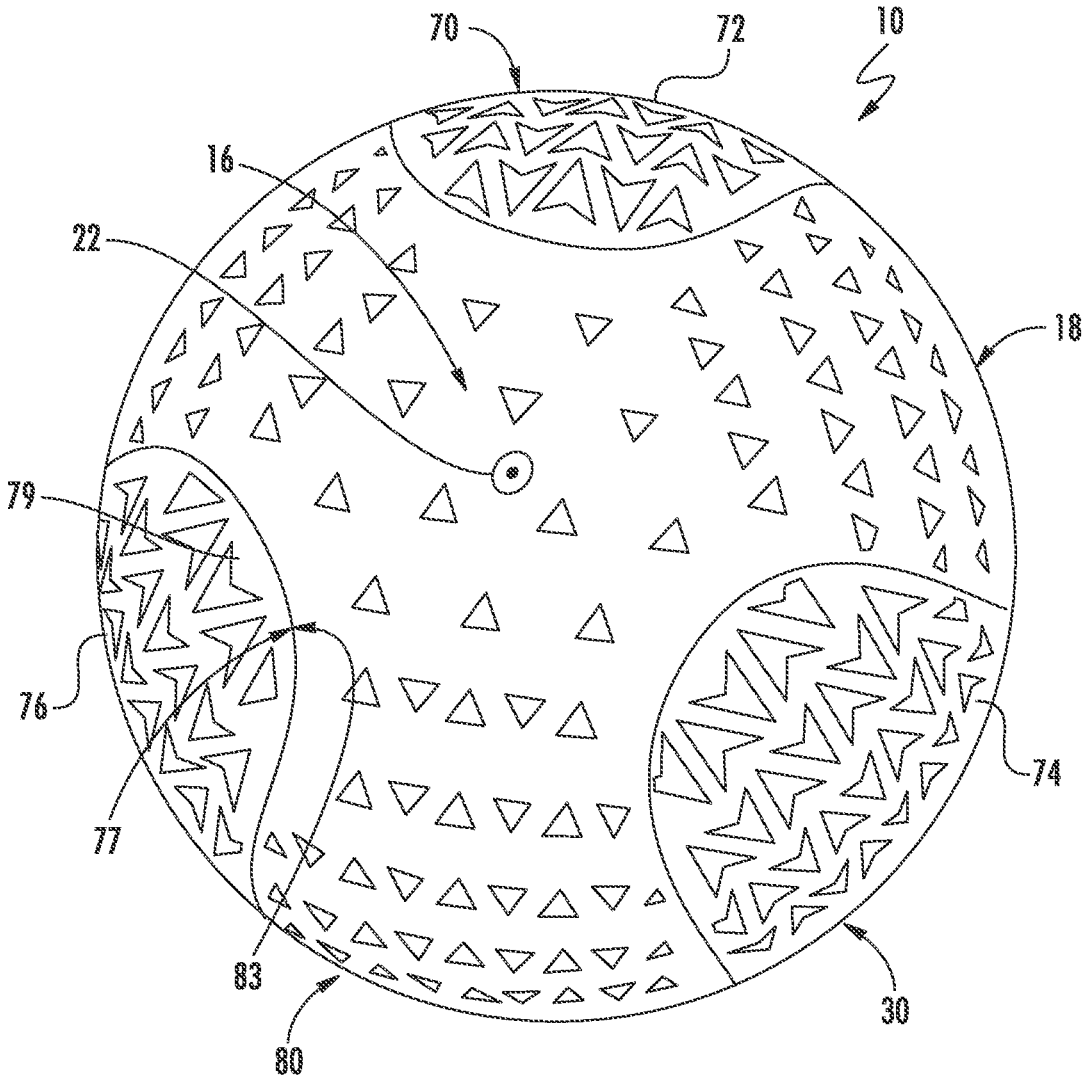
FIG. 4 shows a second pole of the ball of FIG. 1, the second pole opposite the first pole on the ball.

Various views of the ball 10 are shown in FIGS. 1-4. The ball 10 is spherical in shape, and includes various regions including a first pole region 14, a second pole region 16, and an equatorial region 18. The first pole region 14 and the second pole region 16 are generally circular regions that cover a portion of the ball 10 on opposing sides of the ball 10. A first pole exists at the center of the first pole region 14 and a second pole exists at the center of the second pole region 16, the second pole region 16 directly opposite the first pole region 14 on the ball 10. The equatorial region 18 generally circles the entire ball 10 along latitude lines located in a central portion of the ball 10 between the first pole region 14 and the second pole region 16. A circular equator that circles the ball 10 is centered within the equatorial region 18. FIG. 2 shows a side view of the ball 10 at the equatorial region 18. The cross-section noted as V-V in FIG. 2 is taken along a line within the equatorial region, the cross-section being parallel to latitude lines that define the equatorial region 18. FIG. 3 shows a pole view of the ball 10 at the first pole region 14, and FIG. 4 shows a pole view of the ball 10 at a the second pole region 16. While the ball 10 has been defined herein as including a first pole region 14, a second pole region 16 and an equatorial region 18 for convenience in describing the ball 10, it will be recognized that, because the ball 10 is spherical in design with no specific orientation, the various regions 14, 16 and 18 may be defined as existing elsewhere on the ball 10.

Figure 5:
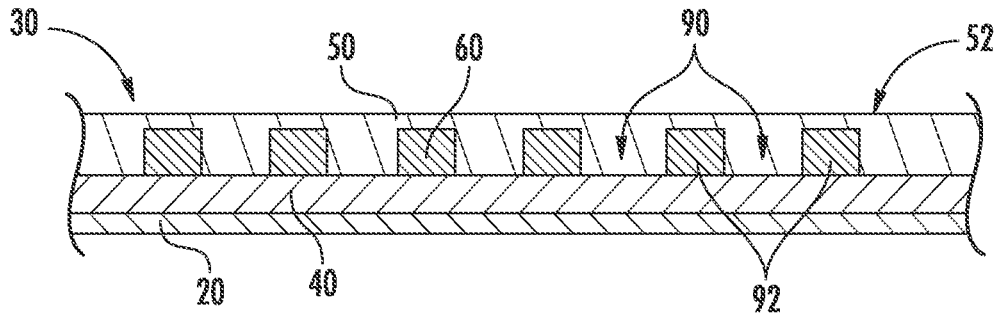
FIG. 5 shows a cross-sectional view of layers of the ball along line V-V of FIG. 1, the layers of the ball including a bladder and a multi-layer cover.

The bladder 20 of the ball is completely covered by the multi-layer cover 30 such that the bladder 20 is hidden from view. FIG. 5 shows a cross-sectional view of the multi-layer cover 30 extending across the bladder 20. The bladder 20 is configured to retain air and is spherical in shape, when inflated. A valve 22 (see FIG. 4) is connected to the bladder 20 and provides a passage through the multi-layer cover 30 and into the interior of the bladder 20. The bladder 20 may be comprised of any of various materials that are non-permeable to air such as latex rubber, butyl or thermoplastic polymer.

With continued reference to FIG. 5, the multi-layer cover 30 includes the substrate layer 40 (which may also be referred to herein as a "backing layer"), the outer layer 50 (which may also be referred to herein as an "outer shell" or "protective layer"), and the intermediate layer 60 (which may also be referred to herein as an "intermediate contouring layer"). The substrate layer 40 is provided by a plurality of separate panels that are directly connected to the bladder 20 with the edges of the panels fitting together to completely cover the bladder 20. The panels of the substrate layer 40 may be connected to the bladder using any of various means such as adhesives or heat fusion. However, in alternative embodiments, the panels of the substrate layer 40 are separated from the bladder 20, such that the bladder is free-floating within the ball, and thus enabling movement of the bladder 20 relative to the substrate layer 40. Once charged, the bladder 20 generates outward pressure on the cover to provide the ball 10 with its round shape.

The substrate layer 40 may be formed from any of various materials. In at least one embodiment, the substrate layer 40 is formed of a compressible material such as foam. By way of example, the foam may be ethylene vinyl acetate (EVA) foam. The EVA may be blended with one or more of an EVA modifier, a polyolefin block copolymer, and a triblock copolymer, and a polyether block amide. In at least one embodiment, the substrate layer 40 is comprised of an open cell or a closed cell foam material such as an EVA foam, neoprene foam, polyethylene foam, or any of various other types of foams. In other embodiments, the substrate layer 40 may be comprised of other types of material, such as fabric sheets of material comprised of cotton, polyester, elastane, or combinations thereof. In various embodiments, the substrate layer 40 may have a thickness between 1 mm and 3 mm, and in at least one embodiment, the substrate layer has a thickness of 2 mm. As noted above, in at least one embodiment, the inner surface of the substrate layer 40 is not connected to the bladder 20, enabling movement of the bladder 20 relative to the substrate layer 40.

Figure 6:
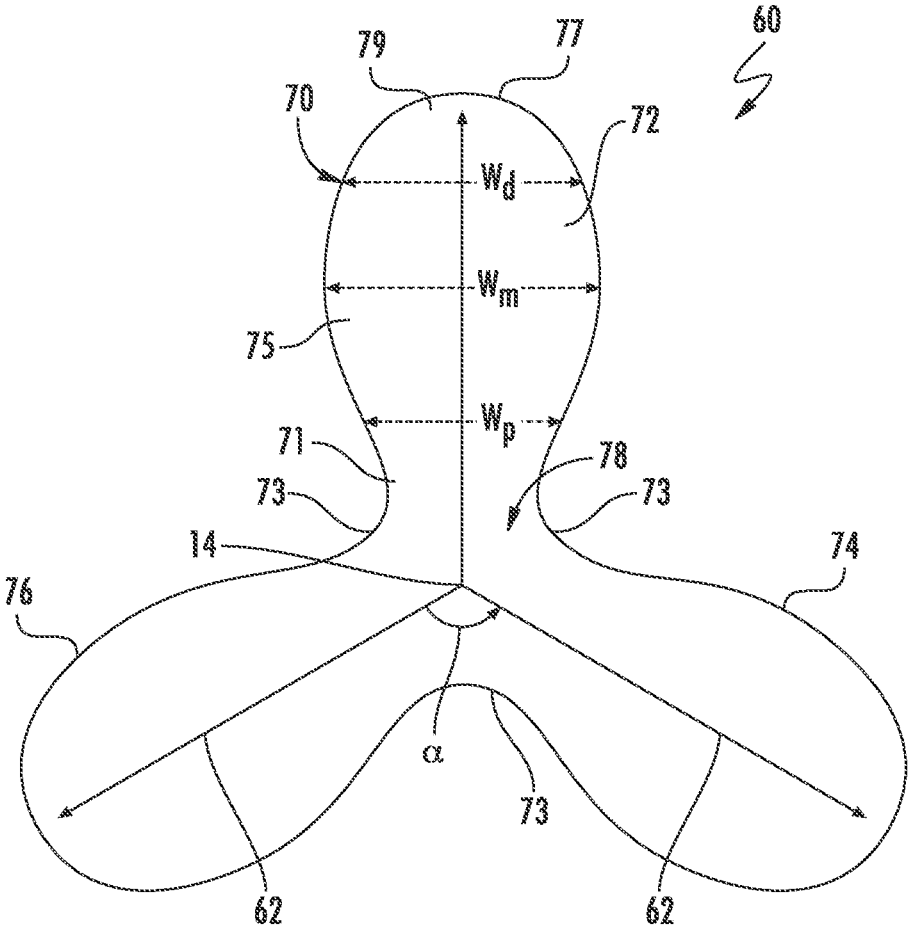
FIG. 6 shows a plan view of a panel of an intermediate layer of the multi-layer cover of FIG. 5, the panel having a Y-shaped configuration with a plurality of arms.

The intermediate layer 60 of the multi-layer cover 30 is sandwiched between the outer layer 50 and the substrate layer 40. The intermediate layer 60 is also formed of compressible material. By way of example, thee compressible material is foam such as ethylene vinyl acetate (EVA) foam having a thickness of approximately 1.0 mm to approximately 3.0 mm (e.g., approximately 2.0 mm). The EVA may be blended with one or more of an EVA modifier, a polyolefin block copolymer, and a triblock copolymer, and a polyether block amide. In the embodiment of FIGS. 1-8, the intermediate layer 60 is formed by two perforated panels 70 and 80 that wrap around the substrate layer 40 and cover the substrate layer 40. A perimeter of the first panel 70 is shown in FIG. 6. The perimeter of the first panel 70 is generally Y-shaped and defines three arms 72, 74, 76. The first panel 70 includes a central portion 78 that defines a first pole region 14 for the ball 10. The central portion 78 is bordered by interior concave perimeter edges 73 that are concave in shape. The three arms 72, 74, 76 extend outwardly from the central portion 78. The longitudinal centerlines 62 of the three arms are separated by an angle, $\alpha$, of approximately 120°. While the embodiment of FIG. 6 shows the intermediate layer 60 as being provided by two panels having a Y-shaped configuration, it will be appreciated that the intermediate layer 60 may also be provided using any number of different panel in any of various configurations. For example, in at least one embodiment similar to that of FIGS. 9-11 described in further detail below, the intermediate layer 60 may be provided by two larger t-shaped (or more specifically, plus sign shaped) panels positioned at the poles of the ball and a number of additional panels positioned along the equator.

The three arms 72, 74, 76 are substantially identical in shape. As shown in FIG. 6, each arm (e.g., arm 72) includes a proximal end 71 and a distal end 79. The proximal end 71 is connected to the central portion 78 of the panel 70. The distal end 79 is not connected to any other portion of the panel 70 and terminates along a convex perimeter edge 77 of the first panel 70 at a remote location on the first panel 70. A middle zone 75 of the arm 72 is positioned between the proximal end 71 and the distal end 79. The middle zone 75 is flared and is also bordered by a convex perimeter. As a result, the arm 72 has a bulbous shape. Stated differently, the middle zone 75 of the arm 72 has a middle width ($w_m$) that is greater than a proximal width ($w_p$) at the proximal end 71 of the arm 72, and greater than a distal width ($w_d$) at the distal end of the arm 72 (i.e., $w_m > w_d > w_p$). The bulbous shape of each of the three arms 72, 74, 76 results in a clover-like shape for the panel 70.

The second panel 80 is substantially identical to the first panel 70. Accordingly, the second panel 80 also has a clover-like shape with three arms 82, 84, 86 arranged in a Y-configuration about a central portion 88. The second pole region 16 is defined at the central portion 88 of the second panel 80. Unlike the first panel 70, the second panel 80 also includes an opening at the pole region 16 with an air valve 22 positioned in the opening (see FIG. 4). The air valve 22 is coupled to the interior bladder 20 and allows the user to insert a needle through the valve 22 and into the interior of the bladder 20 in order to inflate the ball 10 with air.

The first panel 70 and the second panel 80 are configured for interlocking engagement on the ball 10. As shown in FIGS. 1-4 the arms 72, 72, 76 of the first panel 70 mate with the arms 82, 84 and 86 on the second panel 80 such that the perimeter edges of the arms abut and are aligned with one another (e.g., arm 82 is positioned between arms 72 and 74). Accordingly, as shown in FIG. 3, the convex perimeter edges 87 on arms 82, 84 and 86 at the distal end 89 of the second panel 80 are aligned with and abut the concave perimeter edges 73 at the central portion 78 of the first panel 70. Likewise, as shown in FIG. 4, the convex perimeter edges 77 on arms 72, 74 and 76 at the distal end 79 of the first panel 70 are aligned with and abut the concave perimeter edges 83 at the central portion 88 of the second panel 80. In this manner, the first panel 70 and the second panel 80 are interlocked on the ball 10, and the first panel 70 and the second panel 80 extend across the entire sphere formed by the ball 10.

Each of the arms of the first panel 70 and the second panel 80 is perforated such that a plurality of recesses 90 are formed on the first panel 70 and the second panel 80. These recesses 90 are shown in FIG. 5 as providing voids in the intermediate layer such that the outer layer 50 extends through the voids and contacts the substrate layer 40. However, in alternative embodiment, the outer layer 50 may only extend partially into the recesses 90 or may bridge the recesses 90 leaving voids in the recesses 90. In such case, the outer layer 50 may be provided by a film that is applied to the intermediate layer 60. The outer layer 50 may be heat pressed on to the intermediate layer 60 and thereby affixed to the intermediate layer Each of the recesses 90 is formed between interconnected segments 92 on the intermediate layer 60. In the embodiments where the outer layer 50 extends into the recesses 90, the voids in the intermediate layer 60 may be partially or completely filled with the material of the outer layer 50. However, in embodiments wherein the outer layer 50 bridges the recesses 90, voids formed by the recesses 90 remain in the intermediate layer 60.

In the disclosed embodiment, the combination of recesses 90 and interconnected segments 92 form an array of reentrant shapes that provides an auxetic structure. The auxetic structure facilitates curvature of the panels 70 and 80, allowing the intermediate layer 60 to wrap around the sphere of the ball 10 without buckling or creasing.

Figure 7:
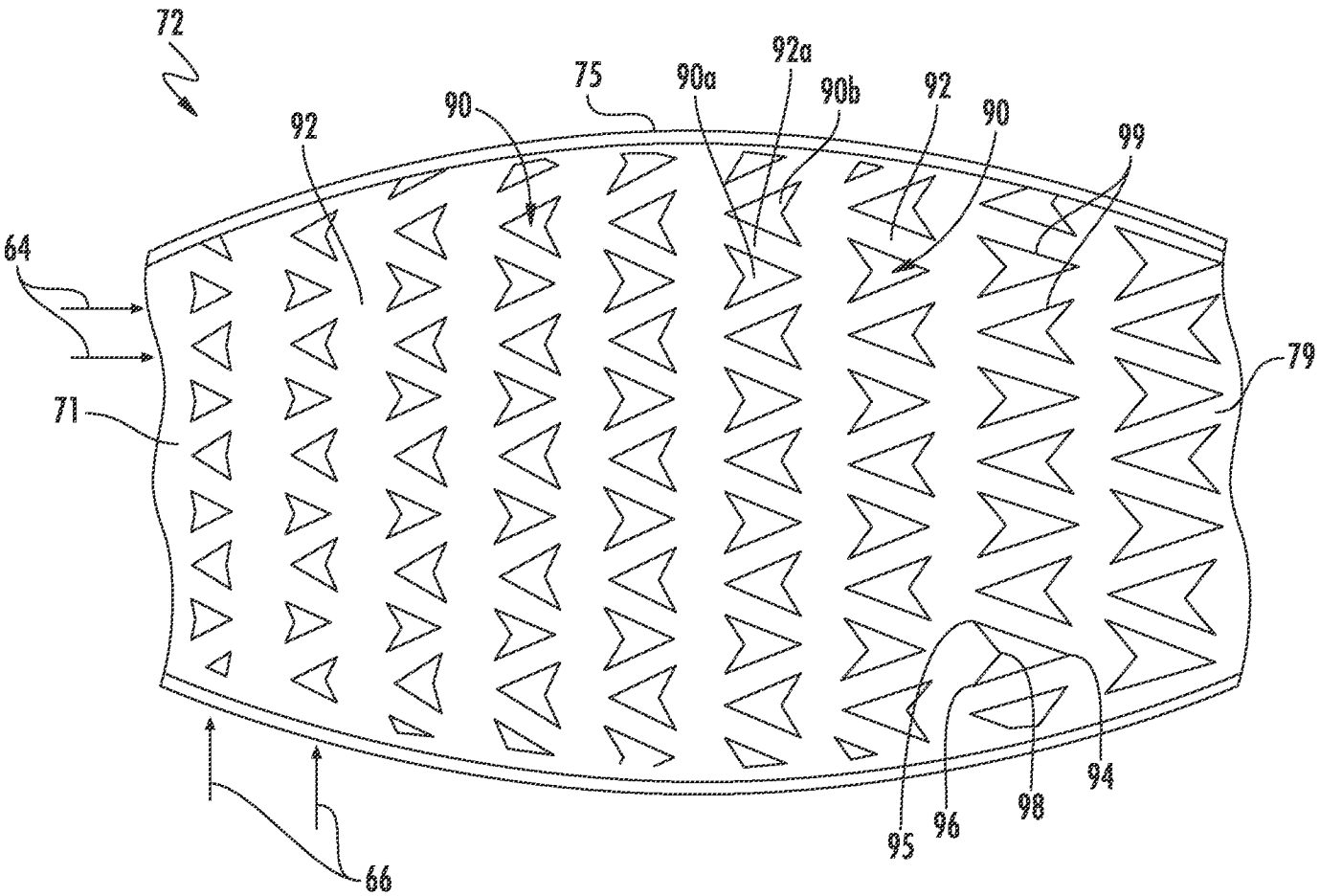
FIG. 7 shows a plan view of an arm of the panel of FIG. 6, the arm including an auxetic structure formed by a plurality of perforations in the panel.

With reference now to FIG. 7, an enlarged view of the middle zone 75 of the first arm 72 of the first panel 70 is shown. As noted previously, the arm 72 includes a plurality of interconnected segments 92 that form an auxetic structure. The interconnected segments 92 are arranged in a manner such that the recesses 90 formed by the interconnected segments 92 form a repeating pattern of reentrant shapes (i.e., concave polygons). In the embodiment of FIG. 7, the repeating pattern of reentrant shapes is an array of reentrant shapes which may be considered to exist in rows and columns of the auxetic structure. Rows are represented in FIG. 7 by arrows 64 and columns are represented by arrows 66. The interconnected segments 92 form the borders for the each interior recess 90, and the perimeter of each interior recess 90 defines a reentrant shape.

The reentrant shapes formed by the recesses 90 and interconnected segments 92 may be any of various shapes capable of providing an auxetic structure. In the embodiment of FIG. 7, the reentrant shapes formed by the recesses 90 are arrowhead shapes (which may also be referred to herein as "chevron" shapes). Each arrowhead shape includes a leading vertex 94 and forms a first acute interior angle for the reentrant shape. Each arrowhead shape also includes a first trailing vertex 95 and a second trailing vertex 96 which form two additional acute interior angles. In addition, each arrowhead shape includes an interior vertex 98 defining a reflex angle which is greater than 180° and results in a reentrant shape.

Together, each set of interconnected segments 92 that forms an interior recess 90 provides a cell unit 99. While each cell unit 99 has a unique interior recess 90, cell units may share the same segment 92. In other words, each segment 92 may border more than one interior recess 90. For example, in FIG. 7, segment 92*a* borders interior recess 90*a* and 90*b*. Accordingly, it will be recognized that a given segment 92*a* may be considered to be a part of multiple cell units, with the segment 92*a* forming a portion of two different reentrant shapes. The collection of segments 92 that surround an interior recess 90 in the auxetic structure may also be referred to herein as "perimeter walls," "cell walls," or "interconnected members." In the embodiment of FIG. 7, the array of reentrant shapes provided by the cell units 99 of the auxetic structure may be considered to exist in rows and columns on the auxetic structure. Two rows are represented by arrows 64 in FIG. 7, and two columns are represented by arrows 66 in FIG. 7.

In the embodiment disclosed herein, the recesses 90 and segments 92 are generally uniform in height across the panels 70 and 80 (i.e., the distance between the substrate layer 40 and the outer layer 50 as shown in FIG. 5 is substantially the same across the entire panel 70 and the entire panel 80). Additionally, the segments 92 have a constant cross-sectional width $W_s$ in a radial direction of the ball (i.e., if a radial cross-section of a segment 92 is taken, such as that shown in FIG. 5, the width $W_s$ of said segment will be the same along the entire radial cross-section). However, the size of the interior recesses 90 varies significantly across the panels 70 and 80. In particular, the size of each successive interior recess 90 gradually increases when moving from the central portion 78 of the panel 70 toward the distal end 79 of the panel 70. At the same time, the width of the segments 92 decrease in width when moving from the central portion 78 of the panel 70 toward the distal end 79 of the panel 70. Therefore, a size gradient for the recesses 90 exists between the proximal end 71 and the distal end 79 of the arm 72. The recesses 90 generally facilitate bending of the panel 70 with larger recesses 90 facilitating more curvature than smaller recesses 90. The recesses 90 of larger size at the distal end 79 of the arm 72 generally facilitate additional degrees of curvature of the panel 70 at the remote portions of the panel 70 than those smaller recesses at more central portions of the panel. Stated differently, the recesses 90 at the central portion 78 of the panel 70 are smaller because the central portion 78 of the panel 70 is only required to bend to a limited degree from the flat position, while the recesses 90 at the distal ends 79 of the panel 70 are larger because the distal ends 79 of the panel 70 are required to bend to a more significant degree from the flat position. In at least one embodiment, the greatest width across a recess varies between 2 mm and 7 mm at the central portion and between 10 and 20 mm at the distal end 79. In at least one particular embodiment, the greatest width across a recess varies from 5 mm at the central portion 78 of the panel 70 to 15 mm at the distal end 79 of the panel 70, with the greatest width growing by about 1 mm in each successive column.

The structure of the intermediate layer 60, including the recesses 90 and the associated auxetic structure provides improved contouring properties around a three-dimension object, such as the ball 10. Accordingly, the intermediate layer 60 provides for a ball having multiple panels and a more spherical shape than other balls comprised of multiple panels. While FIG. 7 shows one embodiment of recesses 90 and an associated auxetic structure that may be used on the ball 10, it will be recognized that the shape of the recesses 90 and associated auxetic structure take a number of different forms. For example, in lieu of the auxetic structure of FIG. 7 wherein the reentrant shapes are provided in the form of arrowhead shapes, the reentrant shapes may be hourglass or bow-tie shapes (which may also be referred to as "auxetic hexagons"). Examples of additional reentrant shapes that may be used to form auxetic structures are disclosed in U.S. patent application Ser. No. 14/137,038, filed Dec. 20, 2013 and published as US Publication No. 20140101816, the entire contents of which are disclosed herein by reference. Alternatively, in at least one embodiment, the shape of the recesses 90 are not reentrant shapes at all, but are instead convex polygons, such as regular polygons or other shapes.

The term "auxetic structure" as used herein generally refers to a structure provided in a configuration that, depending on an appropriately flexible material being used, will have a near zero or negative Poisson's ratio. In other words, when stretched, auxetic structures tend to become thicker (as opposed to thinner) or expand in a direction perpendicular to the applied force, or at least do not contract to a significant extent in a direction perpendicular to the applied force. This generally occurs due to inherent hinge-like components between the interconnected segments which flex when stretched. In contrast, materials with a positive Poisson's ratio that is not near zero contract to a significant extent in a direction perpendicular to the applied outward force (i.e., perpendicular to the direction of stretch). As used herein, an auxetic structure having exhibiting a "near zero" Poisson's ratio is a structure exhibiting a Poisson's ratio of approximately zero and, in particular, less than +0.15.

The term "auxetic structure" as used herein is not limited to structures that actually exhibit a near zero or negative Poisson's ratio in operation. The reason for this is that an entire auxetic structure, or portions thereof, may be practically locked in place and substantially prohibited from expansion or contraction in either direction. For example, a structure comprised of glass may still be considered an "auxetic structure" if it is provided with the appropriate array of reentrant shapes, although forces attempting to stretch the structure will typically result in the structure breaking rather than expanding. Also, components or materials adjacent to, within, or surrounding the auxetic structure may prevent the auxetic structure from exhibiting a near zero or negative Poisson's ratio when stretched.

In the embodiments disclosed herein, auxetic structures are formed from a plurality of interconnected segments 92 forming an array of cell units 99, and each cell unit has a "reentrant shape". The term "reentrant shape" may also be used herein to refer to a "concave", or "non-convex" polygon or shape, which provides shape having an interior angle with a measure that is greater than 180°. The angle at vertex 98 in FIG. 7 is an angle in a reentrant shape having a measurement of greater than 180°. The auxetic structure in FIG. 7 is one example of such an auxetic structure defining a reentrant shape. It will be appreciated that numerous other auxetic structures defining reentrant shapes are possible, as noted previously.

The intermediate layer 60 may be formed by any of various materials suitable for the desired purposes. In at least one embodiment, the intermediate layer is provided by an open cell or a closed cell foam material such as a neoprene foam, polyethylene foam, or any of various other types of foams. In other embodiments, the intermediate layer 60 may be comprised of other types of material, such as ethylene-vinyl acetate (EVA), a thermoplastic such as nylon, or a thermoplastic elastomer such as polyurethane, or any of various other polymer materials exhibiting sufficient flexibility and elastomeric qualities required by the intermediate layer 60.

Figure 8:
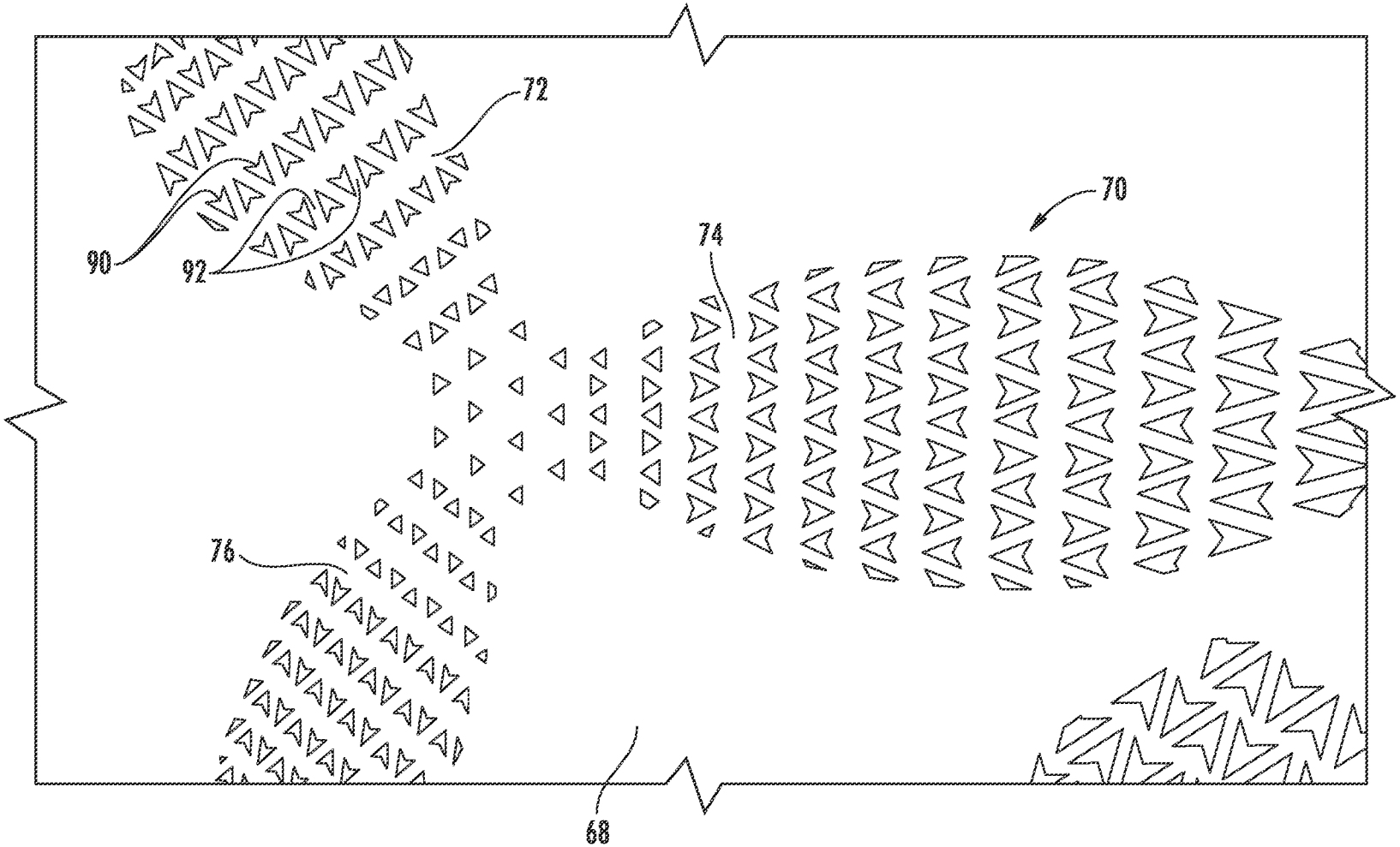
FIG. 8 shows the panel of FIG. 6 on a sheet prior to cutting the sheet in the Y-shaped configuration for the panel.

In addition to being formed of any of various materials, the intermediate layer 60 may be formed using any of various methods. By way of example, the intermediate layer 60 may be formed by die-cutting a sheet of material, such as a neoprene foam, the die cutting forming both the shape of the panels 70 and 80, as well as forming the recesses 90 in the panels 70 and 80. FIG. 8 shows a sheet of material 68 that is used to form the panel 70 of the intermediate layer 60. As shown in FIG. 8, the arms 72, 74 and 76 of the panel 70 can all be seen along with the associated recesses 90 and segments 92 prior to the panel 70 being die-cut from the sheet of material 68. Alternatively, in lieu of die-cutting, the intermediate layer 60 may be formed via a molding process such as compression molding or injection molding. By way of further example, the intermediate layer 60 may be formed via an additive manufacturing process such as selective laser sintering (SLS) to form a three dimensional structure. As yet another example, the intermediate layer 60 may be formed using a three-dimensional printing process.

After the intermediate layer 60 is formed, the intermediate layer 60 is connected to the substrate layer 40. The intermediate layer 60 may be connected to the substrate layer 40 using any of various connection methods, including fusing, heat transfer, adhesives, or any of various other connection methods as will be recognized by those of ordinary skill in the art.

With reference again to FIG. 5, the outer layer 50 completely covers the intermediate layer 60 on the ball 10. The outer layer 50 may be provided by a protective membrane or film covering the intermediate layer 60. Accordingly, the outer layer may be formed of an elastomeric polymer such as thermoplastic polyurethane or a thermosetting polymer such as polyurethane. The outer layer 50 possesses a thickness that is less than the thickness of each of the substrate layer 40 and intermediate layer 60. By way of example, the outer layer 50 may possess a thickness that is no more than half the thickness of each of the substrate layer 40 and the intermediate layer 60. In at least one embodiment, the outer layer 50 may possess a thickness of approximately 0.50 mm to approximately 1.0 mm (e.g., approximately 0.70 mm).

In the disclosed embodiment, the outer layer 50 is provided by a transparent elastomer material, such as a transparent thermoplastic polyurethane (TPU). The transparent elastomer material provides a cover layer that physically protects the intermediate layer 60 but visually exposes the interlocking panels 70 and 80 of the intermediate layer 60, including the shape and color of the interlocking panels 70 and 80 and the recesses 90. The term "transparent" as used herein includes materials that are semitransparent or translucent, but remain sufficiently transparent to allow sufficient light to pass such that a human may view the shapes and configurations of the recesses 90 in the intermediate layer 60. This transparent outer layer 50 in combination with the perforated intermediate layer 60 provides a unique look for the ball 10 with the interlocking panels 70 and 80 of the intermediate layer exposed under the outer layer 50 along with the associated recesses 90 and segments 92.

While FIG. 5 shows the outer layer 50 as completely filling the recesses 90, it will be recognized that in other embodiments the outer layer 50 may only partially fill the recesses 90 or may extend completely across the recesses 90 without entering the recesses to a significant extent. The extent to which the outer layer 50 fills the recesses 90 may depend, in part on the material used to form the outer layer 50 and the method used to apply the outer layer 50 to the intermediate layer 60.

The outer surface 52 of the outer layer 50 may be textured to provide the ball 10 with a desired tactile feel and aerodynamic qualities. While TPU is disclosed herein as providing the outer layer 50 in at least one embodiment, it will be recognized that in other embodiments any of various other materials may be used for the outer layer 50, including any of various natural or synthetic materials. The material selected for the outer layer 50 will depend, in part, on a number of different desired performance characteristics for the ball 10.

In at least one embodiment, the outer layer 50 is not applied to the intermediate layer 60 until after the intermediate layer is applied to the substrate layer 40. In this embodiment, the outer layer 50 may be sprayed or otherwise applied to the intermediate layer 60, resulting in a monolithic outer surface that is free of seams. Alternatively, the outer layer 50 may be formed by a film that is applied to the intermediate layer 60 and then heat pressed to secure the outer layer 50 to the intermediate layer 60. The process of pressing the outer layer 50 on to the intermediate layer may include the application of various seams, dimples or other indentations on the surface of the ball 10. In yet another embodiment, the outer layer 50 is applied to each panel 70, 80 of the intermediate layer 60 prior to the intermediate layer 60 being applied to the substrate layer 40. In this embodiment, the outer layer may be applied to the intermediate layer using any of various means as described above, but the outer layer incudes seams associated with each panel, the seam extending along the perimeter of the panels 70 and 80.

Figure 9:
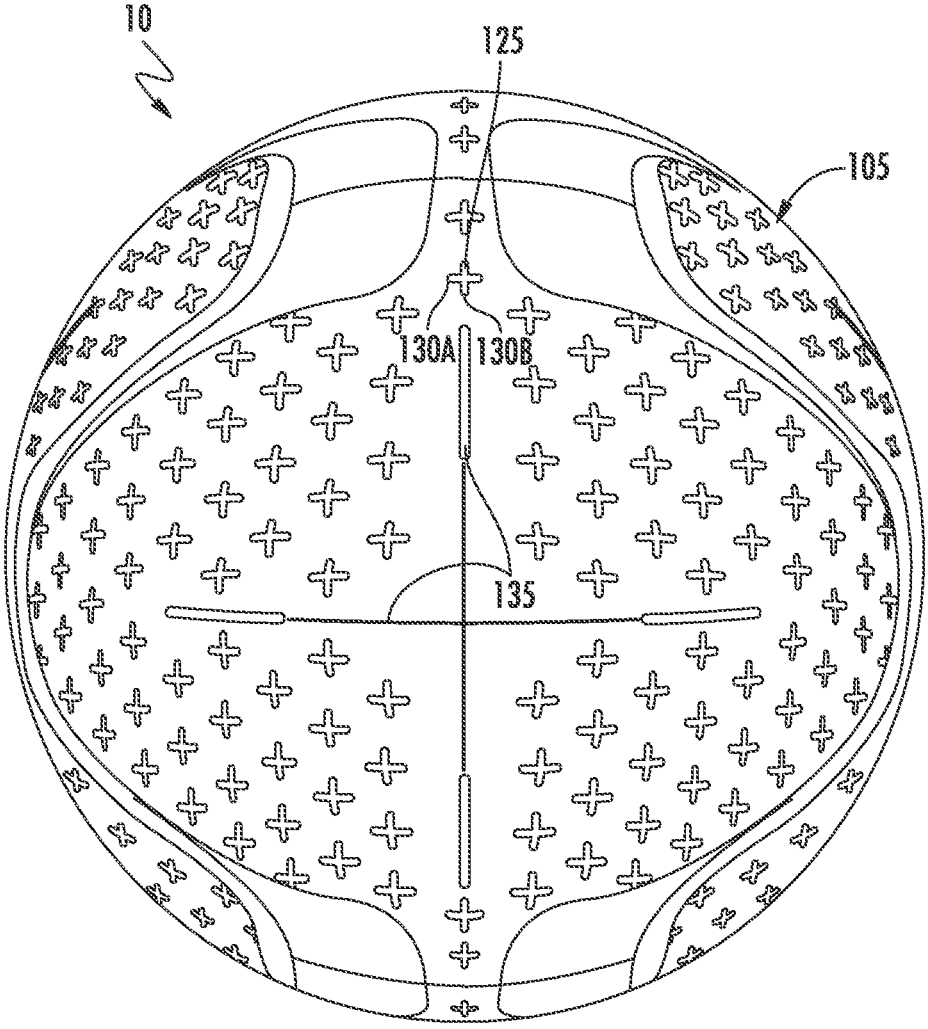
FIG. 9 shows a perspective view of a sports ball in accordance with an embodiment of the disclosure.
Figure 10:
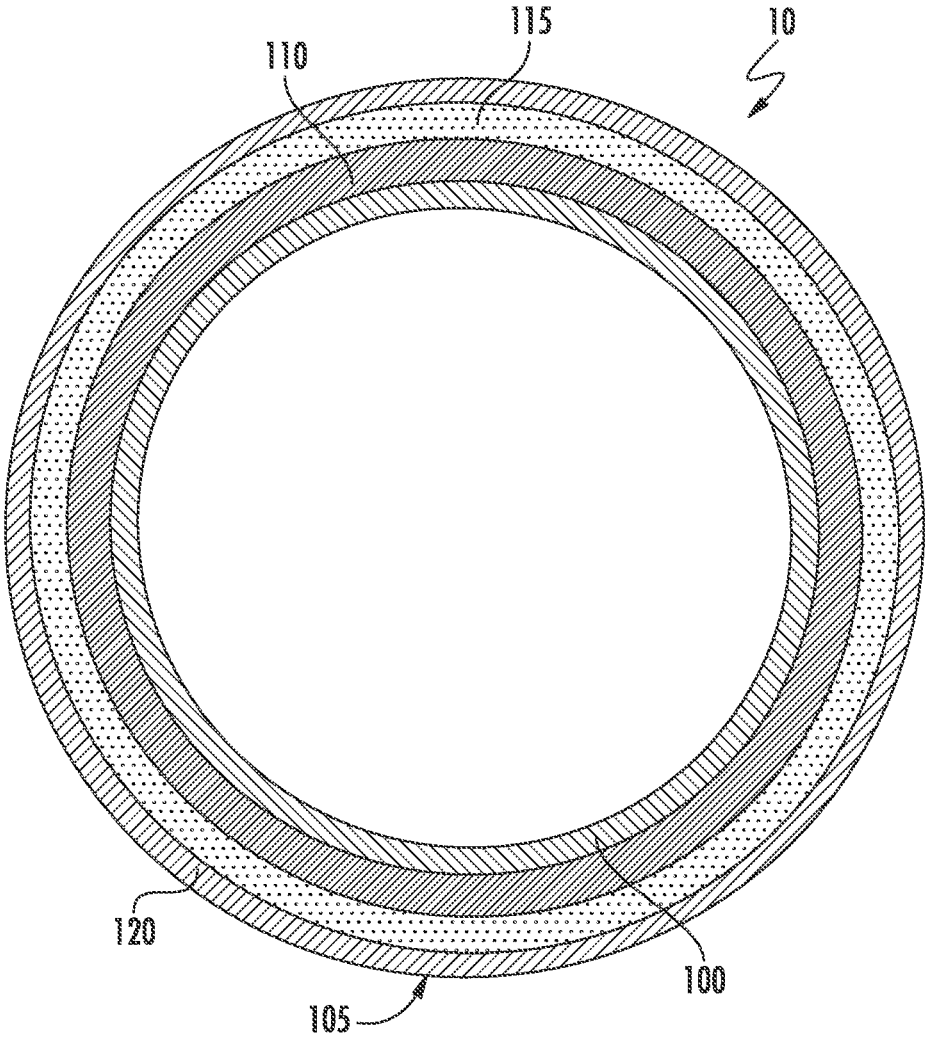
FIG. 10 shows a schematic of the sports ball of FIG. 9, showing layers in cross section.
Figure 11:
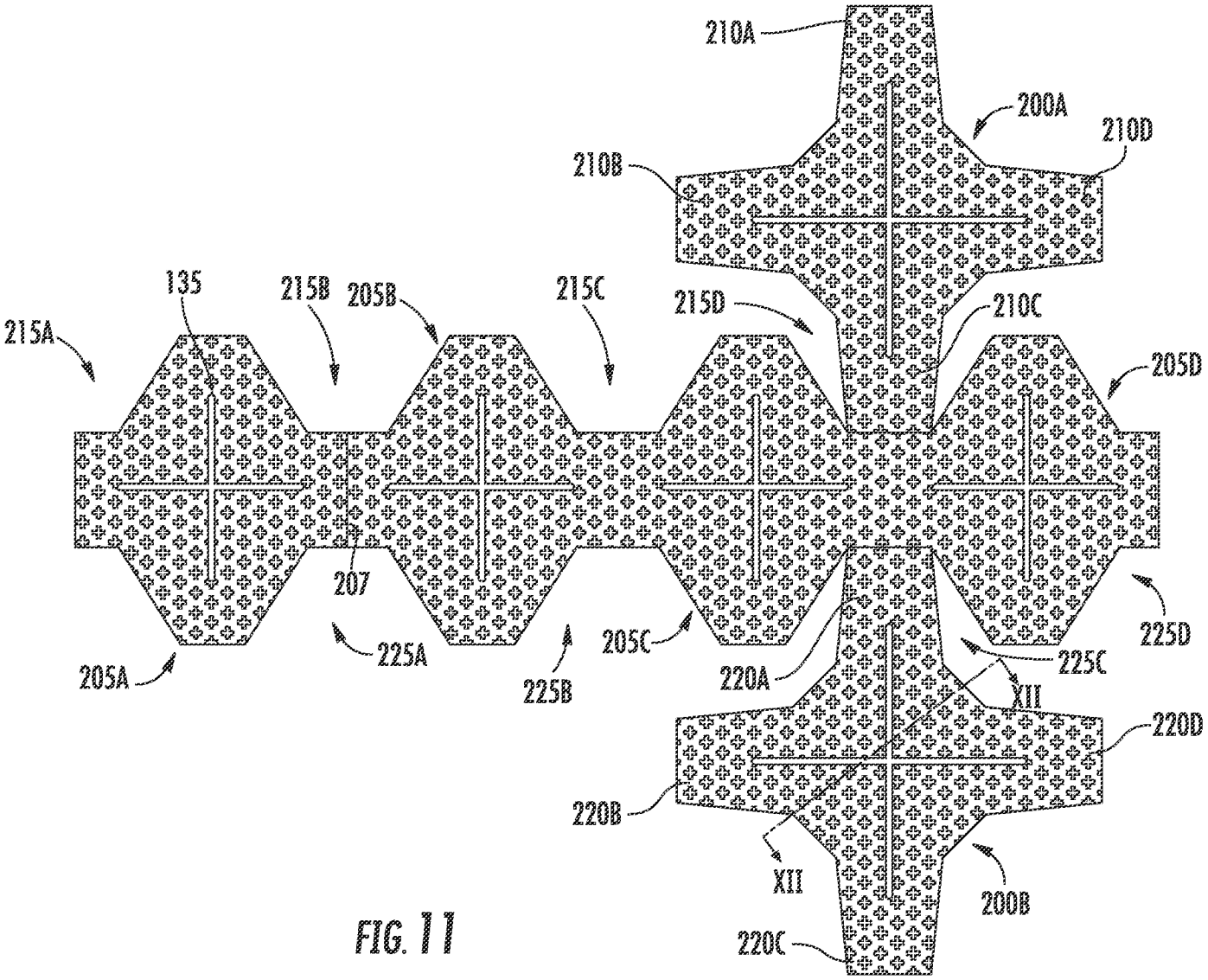
FIG. 11 shows a schematic of the panel layout of the sports ball of FIG. 9.

FIGS. 9-11 illustrate a sports ball in accordance with another embodiment of the disclosure. Ball 10 includes a bladder 100 surrounded by a cover 105. The bladder 100 is hollow sphere charged with fluid (air). Similar to that described above, in an embodiment, the bladder is formed of a thermoplastic polymer film such as rubber. The bladder 100 is free-floating, being separated from the cover. Once charged, the bladder 100 generates outward pressure on the cover to provide the ball 10 with its round shape.

The cover 105 is a laminate structure including an inner backing or reinforcing layer 110, an intermediate contouring layer 115 surrounding the backing layer 110, and an outer shell or protective layer 120 surrounding the contouring layer 115. The outer surface of the backing layer 110 is coupled (e.g., bonded or connected) to the inner surface of the contouring layer 115. Similarly, the outer surface of the contouring layer 115 is coupled (e.g., bonded or connected) to the inner surface of the shell layer 120. With this configuration, the layers 110, 115, 120 forming the laminate are generally coextensive with each other.

The backing layer 110 is a layer operable to protect the bladder. The backing layer 110 is formed of a compressible material such as foam. By way of example, the foam may be ethylene vinyl acetate (EVA) foam. The EVA may be blended with one or more of an EVA modifier, a polyolefin block copolymer, and a triblock copolymer, and a polyether block amide. In an embodiment, the foam layer is an ethylene vinyl acetate foam possessing a thickness of about 1 mm to about 3 mm (e.g., 2 mm). As noted above, the inner surface of the backing layer 110 is not connected to the bladder, enabling movement of the bladder relative to the backing layer.

The contouring layer 115 is operable to conform to the exterior surface of the bladder and/or influence the expansion pattern of the cover. The contouring layer 115 is formed of compressible material. By way of example, thee compressible material is foam such as ethylene vinyl acetate (EVA) foam having a thickness of approximately 1.0 mm to approximately 3.0 mm (e.g., approximately 2.0 mm). The EVA may be blended with one or more of an EVA modifier, a polyolefin block copolymer, and a triblock copolymer, and a polyether block amide.

The contouring layer 115 may possess a perforated structure similar to that described above for the intermediate layer 60. In the illustrated embodiment, the contouring layer 115 is a discontinuous or perforated layer defining an array of apertures 125 organized in a series of rows and columns. Each aperture 125 extends completely through the layer, forming a void that exposes the backing layer 110. The shape of the aperture 125 may be any suitable for its described purpose. For example, the apertures may possess a polygonal shape. As shown in the embodiment of FIGS. 9-11, in at least one embodiment the apertures are t-shaped (or more specifically, plus sign shaped) apertures. Accordingly, as shown in FIG. 9, each of the apertures 125 includes a first elongated slot 130A that intersects a second elongated slot 130B, the slots being oriented perpendicular to each other. The dimensions of each slot 130A, 130B may be any suitable for its described purpose. In an embodiment, the thickness (transverse dimension) of each slot 130A, 130B is approximately 1.0 mm, while its length (longitudinal dimension) is approximately 7.0 mm.

In other embodiments, the array of apertures 125 are provided via an array of auxetic shapes as described above. For example, the array of apertures 125 may be configured to form auxetic structures that define arrowhead shapes, hourglass or bow-tie shapes, or any of various other auxetic shapes.

In an embodiment, the apertures 125 define at least 5% of the surface area but no more than 50% of the surface area of the contouring layer 115. By way of example, a predetermined number of apertures 125 sufficient to expose 5% to 50% of the backing layer 110 (e.g., 10%-20%) may be utilized.

The array of apertures 125 are configured to lower the Poisson's ratio of the foam layer. That is, comparing the perforated foam layer to a solid (non-perforated) foam layer with a similar construction, the perforated foam layer will possess a lower Poisson's ratio. In a preferred embodiment, the Poisson's ratio is less than zero. Lowering the Poisson's ratio of the contouring layer 115 improves the layer's ability to conform to a surface having a double curvature (e.g., a dome or sphere). Accordingly, providing the cover with the contouring layer improves the ability of the cover (e.g., its panels) to wrap around the bladder without creasing, bunching, etc. Improving contouring, in turn, enables formation of a ball with a simplified cover structure, e.g., a cover requiring less panels than conventional soccer balls, which currently include 32 separate panels secured around the bladder.

Additionally, the array of apertures 125 lowers the overall weight of the foam layer. That is, comparing the perforated foam layer to a solid foam layer with a similar construction, the perforated foam layer will possess a lower weight.

The shell layer 120 is a protective membrane or film covering the contouring layer 115. The shell layer 120 is formed of an elastomeric polymer such as thermoplastic polyurethane or a thermosetting polymer such as polyurethane. The shell layer 120 possesses a thickness that is less than the thickness of each of the backing layer 110 and contouring layer 115. By way of example, the shell layer 120 may possess a thickness that is no more than half the thickness of each sublayer 110, 115. Accordingly, the shell layer 120 may possess a thickness of approximately 0.50 mm to approximately 1.0 mm (e.g., approximately 0.70 mm).

The shell layer 120 may further include one or more turbulator structures operable to affect the aerodynamic properties of the ball 10. The term aerodynamic property refers to the properties of airflow along the surface (e.g., within a boundary layer along the surface) of the shell layer 120 (e.g., create or alter laminar and/or turbulent flow) and associated drag (e.g., reduction of form drag, interference drag, and/or surface friction). The challenges with reducing drag to enhance aerodynamic performance of an object moving within a fluid medium (e.g., air) can be complicated and depend upon a number of variables including, without limitation, speed of the object as it flows through the fluid medium, exterior profile of the object (including contour and degree of smoothness/roughness of the object surface), type of fluid medium, and orientation of the object as it travels through the fluid medium. The fluid flow patterns around an object can be characterized in terms of its Reynolds number, Re, where Re is a dimensionless value that is a function of surface dimension(s) of the object (e.g., a surface dimension of the object about which the fluid medium flows), the velocity of the object within a fluid medium, and the density and viscosity of the fluid medium. The Reynolds number has the following formula:

$$Re=(\rho vL)/\mu$$

where:

$\rho$=density of fluid medium;

$v$=mean velocity of object relative to fluid medium;

$L$=traveled length of the fluid medium around object; and $\mu$=viscosity of fluid medium.

Fluid flowing within a boundary layer around an object (i.e., within the immediate vicinity of the object surface) can be defined as laminar or turbulent based upon the Re value associated with the conditions of the object moving within the fluid medium. In particular, laminar flow occurs at low Re values, where viscous forces tend to dominate and there is a smooth, constant fluid motion of the fluid medium within the boundary layer around the object. In contrast, turbulent flow occurs at high Reynolds numbers where inertial forces tend to dominate and produce chaotic eddies, vortices and other flow instabilities for the fluid medium within the boundary layer.

When considering fluid flow around a rounded object (e.g., a sphere such as a ball), laminar flow of the fluid medium within a boundary layer around the object does not tend to follow the surface of the object but instead tends to separate from the boundary layer so as to increase drag on the object moving through the fluid medium. In contrast, turbulent flow of the fluid medium within the boundary layer around the object tends to follow the object surface contour thus reducing drag on the object as it moves through the fluid medium. Generally, when relative velocity between the object and fluid medium is very high, fluid flow around the object tends to be turbulent while a relative velocity that is very low tends to result in laminar fluid flow around the object. By increasing the overall surface roughness of certain shell layer 120, fluid flows that might otherwise be laminar will transition to turbulent within the boundary layer at the surfaces of such body portions which results in a further overall drag reduction (i.e., enhanced aerodynamic properties imparted) for the object moving through the fluid medium.

Accordingly, forming turbulator structures into the surface of the shell layer 120 reduces the drag on the ball as it travels through air. Turbulator structures may include one seams, indentations, concavities, dimples, irregularities, and/or recesses effective to impart an uneven, roughened or undulating surface topology to the shell layer. For example, the shell layer 120 includes elongated indentations 135, which are formed by applying compression and heat to selected areas of the shell. For example, in the embodiment of FIGS. 9-11, the shell layer 120 includes indentations 135 in the form of intersecting grooves that provide a number of t-shaped (or more specifically, plus sign shaped) channels on the outer shell 120. In at least some embodiments, application of compression and heat to the shell layer 120 also results in associated indentations being formed in the contouring layer 115.

In addition to the indentations 135, the exterior surface of the shell layer 120 may define a dimple 145 (see FIG. 12, described in further detail below), concavity or other recess associated with each location where an aperture 125 is provided on the contouring layer 115. That is, the shell layer 120 may confirm closely to the surface of the contouring layer 115, resulting in a cover topology with dimples 145 that are aligned with the apertures 125 of the contouring layer 115. The dimples 145 on the shell layer 120 may be any of various shapes, including round or polygonal shapes. In at least one embodiment, the shape of each dimple matches each associated t-shaped aperture 125 on the contouring layer 115. The dimples and indentations are further defined by a maximum depth. For example, the depth of the dimples and indentations may range from 0.5 mm to 2 mm in various exemplary embodiments. In some embodiments, the depth of the dimples 145 and indentations 135 may be less than the thickness of the shell layer 120, but in some embodiments, the depth of the dimples 145 and indentations may extend past the outer surface of the contouring layer 115. Together, the dimples 145 and associated indentations 135 reduce drag and encourage lift during ball flight. Accordingly, the dimples 145 and indentations 135 serve to provide a ball with improved flight properties and a consistent flight pattern.

In addition to the dimples and indentations 135, the shell layer 120 of the ball may also include a pattern of slight surface irregularities. These surface irregularities are generally provided in a repeating pattern across the entire outer surface of the shell layer. The surface irregularities generally have a depth (or height) of less than 1 mm. In addition to affecting aerodynamic properties, the slight surface irregularities are configured to provide a tactile feel to the ball and aiding friction (for ball control).

The cover 105 may be formed as a series of panels coupled together via, e.g., stitching, adhesive, etc. Referring to FIG. 11, the cover 105 includes a first panel 200A and a second panel 200B oriented along the poles of the ball 10. The first panel 200A and the second panel 200B define a generally t-shaped (or more specifically, plus sign shaped) configuration. In addition, the cover 105 includes a series of panels configured to span the equator of the ball 10. Specifically, the cover 105 includes a first panel 205A, a second panel 205B, a third panel 205C, and a fourth panel 205D. The panels 205A-205D have an irregular dodecagon configuration (i.e., a 12-sided irregular polygon). The t-shaped indentations 135 of the outer shell 120 are centrally located on each of the panels 200A, 200B, 205A, 205B, 205C, 205D. Panels 200A, 200B, 205A, 205B, 205C, 205D are connected to each other via seams 207. The seams may be joined using conventional approaches (stitching, adhesive, etc.).

The panels 200A, 200B are configured to interlock with panels 205A, 205B, 205C, 205D. Specifically, the first panel 200A includes teeth 210A, 210B, 210C, 210D that intermesh with notches 215A, 215B, 215C, 215D formed by adjacent equator panels 205A-205D. Similarly, the second panel 200B includes teeth 220A, 220B, 220C, 220D that intermesh with notches 225A, 225B, 225C, 225D formed by adjacent equator panels 205A-205D. This is in contrast with conventional soccer balls which apply a series of individual hexagonal pieces along the surface. Accordingly, in addition to improved contouring, the sports ball described above minimizes the numbers of seams required to form the cover 105.

Figure 12:
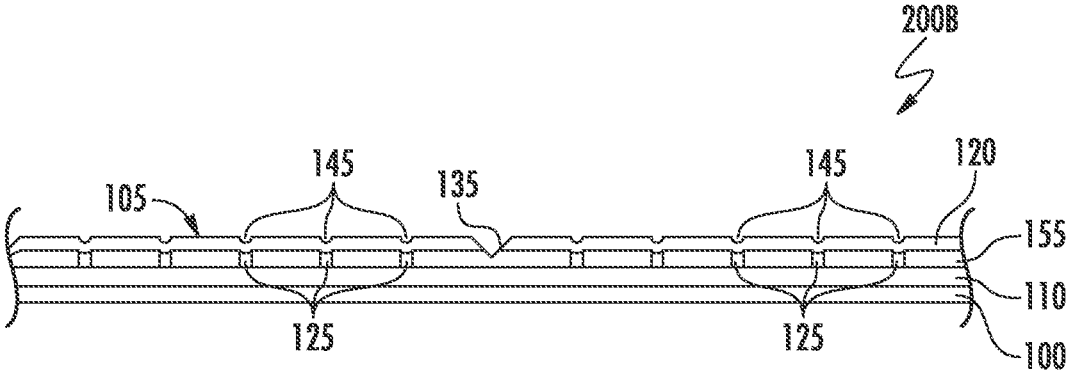
FIG. 12 shows a cross-sectional view of one of the panels of FIG. 11.
Figure 13:
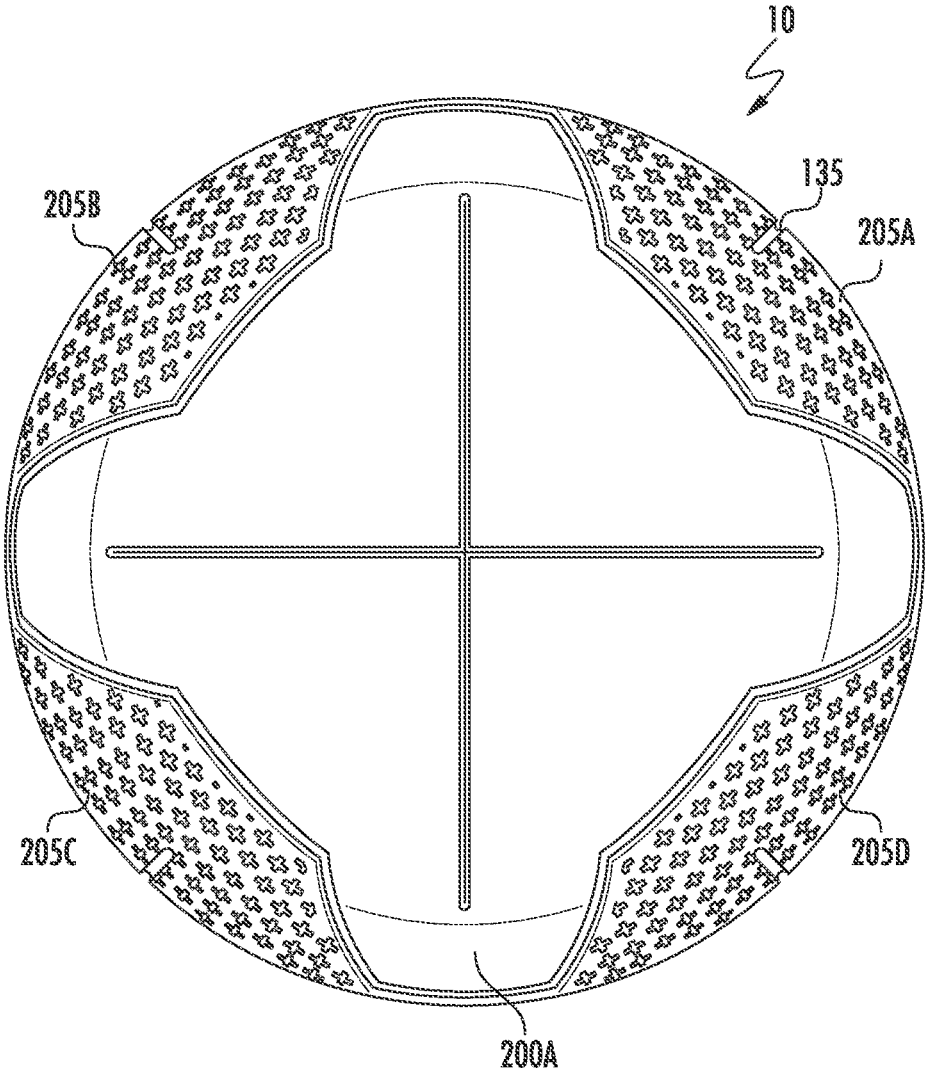
FIG. 13 shows a perspective view of a sports ball in accordance with yet another embodiment of the disclosure.

FIG. 12 shows a cross-sectional view of the panel 200B of FIG. 11 arranged on the bladder 100 of the ball in a flat configuration. As described previously, the panel 200B includes a backing layer 110, a perforated contouring layer 115, and an outer layer 120. FIG. 12 illustrates how a dimple 145 is associated with each of the apertures 125 in the contouring layer 115. In particular, each dimple 145 is positioned radially outward from each aperture 125, the radial direction defined by the sphere of the ball 10, and therefore, each dimple 145 is aligned with an associated aperture 125. Depending on the depth of the dimples 145, the outer layer 120 may extend into the apertures 125 associated with the dimples 145. As noted previously, the dimples may be any of various shapes and sizes, and in at least some embodiments, the dimples 145 are complimentary in shape to the apertures 125 (e.g., plus sign shaped).

Because each dimple 145 is associated with one of the apertures 125, it will be recognized that a human person feeling the dimples 145 on the outer surface of the outer layer 120 of the ball with his or her sense of touch will be able to tactilely detect the existence of the apertures 125 in the contouring layer 115. Additionally, as noted previously, the outer layer 120 is comprised of a transparent material. Accordingly, a human person viewing the outer layer 120 of the ball 10 with his or her sense of sight will also be able to visually detect the existence of the apertures 125 in the contouring layer 115. Accordingly, it will be recognized that in various embodiments the apertures 125 in the contouring layer 115 may be detected by a human using one or more senses of the human.

While the panels of FIG. 11 disclose an embodiment wherein all of the panels of the ball include a perforated contouring layer 115, it will be recognized that in at least some embodiments some of the panels do not include a perforated contouring layer. For example, FIG. 12 shows an alternative embodiment wherein the contouring layer of the panel 200A is not perforated, but other panels 205A, 205B, 205C, and 205D are perforated. This provides a unique configuration wherein a trademark, logo, name, text, or some design element may be presented on the panel 200A, while the perforations 125 are all visible on panels 205A, 205B, 205C, and 205D through the transparent outer shell.

While the ball 10 has been described herein as a soccer ball in the disclosed embodiment, it will be appreciated that the ball 10 may also be provided as another type of ball. For example, the ball 10 may be a basketball, football, volleyball, softball, golf ball, or any of various other types of balls, including any type of ball having a multi-layer cover.

The foregoing detailed description of one or more exemplary embodiments of the sports ball having a flexible cover layer has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

I claim:

1. A ball comprising:

a bladder;

a contouring layer surrounding the bladder, the contouring layer including at least one panel defining a plurality of circumferentially arranged segments and a plurality of apertures configured to lower a Poisson's ratio of the contouring layer, wherein each of said apertures forms a reentrant shape that remains constant extending through the at least one panel in a radial direction of the ball; and an outer layer covering the contouring layer, the outer layer including a plurality of dimples, each of the plurality of dimples aligned with one of the plurality of apertures.

2. The ball of claim 1 wherein the at least one panel is a perforated sheet defining a repeating pattern of reentrant shapes with each of the apertures formed within one of the reentrant shapes.

3. The ball of claim 1 wherein the outer layer is comprised of a transparent material such that each of the plurality of apertures is visible through the outer layer.

4. The ball of claim 1 wherein the contouring layer is an auxetic structure exhibiting a near zero Poisson's ratio.

5. The ball of claim 1 wherein the at least one panel includes a first t-shaped panel at a first pole of the ball, a second t-shaped panel at a second pole of the ball, and a plurality of equator panels spanning an equator of the ball, each of the equator panels covering a portion of the equator and extending from the first t-shaped panel to the second t-shaped panel.

6. A ball comprising:

a bladder;

a near-auxetic contouring layer surrounding the bladder, the contouring layer including a perforated sheet defining a plurality of apertures that extend through the perforated sheet from one side of the sheet to an opposing side of the sheet, each of the plurality of apertures defined within segments of the contouring layer, the segments having a constant cross-sectional width in a radial direction of the ball; and an outer layer surrounding the contouring layer, the outer layer including a plurality of dimples, each of the plurality of dimples aligned with one of the plurality of apertures such that a position of each of the plurality of apertures is tactilely detectable via the outer layer.

7. The ball of claim 6 wherein the plurality of segments defines a repeating pattern of reentrant shapes with each of the apertures formed within one of the reentrant shapes, and wherein each of said apertures extends through the perforated sheet such that the contouring layer has a constant cross-sectional shape in a radial direction of the ball.

8. The ball of claim 6 wherein the outer layer is comprised of a transparent material such that each of the plurality of apertures is visible through the outer layer.

9. The ball of claim 6 wherein the contouring layer exhibits a Poisson's ratio of less than 0.15.

10. The ball of claim 6 wherein the contouring layer includes a first t-shaped panel at a first pole of the ball, a second t-shaped panel at a second pole of the ball, and a plurality of equator panels spanning an equator of the ball, each of the equator panels covering a portion of the equator and extending from the first t-shaped panel to the second t-shaped panel.

* * * * *